US008072144B2

(12) United States Patent
Lee et al.

(10) Patent No.: US 8,072,144 B2
(45) Date of Patent: Dec. 6, 2011

(54) PLASMA DISPLAY PANEL WITH IMPROVED CONTRAST CHARACTERISTICS

(75) Inventors: Gibum Lee, Gumi (KR); Jihoon Lee, Gumi (KR); Seongnam Ryu, Gumi (KR); Jongmun Yang, Gumi (KR); Myongsoon Jung, Gumi (KR); Jain Goo, Gumi (KR); Jeonghyun Hahm, Gumi (KR); Hyeonjae Lee, Gumi (KR); Jinyoung Kim, Gumi (KR)

(73) Assignee: LG Electronics Inc., Seoul (KR)

( * ) Notice: Subject to any disclaimer, the term of this patent is extended or adjusted under 35 U.S.C. 154(b) by 10 days.

(21) Appl. No.: 12/306,949

(22) PCT Filed: Jan. 16, 2008

(86) PCT No.: PCT/KR2008/000274

§ 371 (c)(1),
(2), (4) Date: Dec. 30, 2008

(87) PCT Pub. No.: WO2009/014290

PCT Pub. Date: Jan. 29, 2009

(65) Prior Publication Data

US 2010/0231128 A1 Sep. 16, 2010

(30) Foreign Application Priority Data

Jul. 20, 2007 (KR) ..... 10-2007-0073158

(51) Int. Cl.
*H01J 17/49* (2006.01)

(52) U.S. Cl. ..... 313/587; 313/582; 501/49

(58) Field of Classification Search ..... 313/582, 313/587; 501/64
See application file for complete search history.

(56) References Cited

U.S. PATENT DOCUMENTS 5,661,500 A * 8/1997 Shinoda et al. ..... 313/585
7,009,587 B2 3/2006 Nishimura et al.
(Continued)

FOREIGN PATENT DOCUMENTS

JP 2005-053770 3/2005
(Continued)

OTHER PUBLICATIONS

PCT Notification of Transmittal of the International Search Report and the Written Opinion for Application No. PCT/KR2008/000274 mailed May 2, 2008 (12 pages).

*Primary Examiner* — Peter Macchiarolo
(74) *Attorney, Agent, or Firm* — Fish & Richardson P.C.

(57) ABSTRACT

A plasma display panel is disclosed. The plasma display panel includes a front substrate on which a scan electrode and a sustain electrode are positioned, a first black layer positioned between the scan electrode and the front substrate and between the sustain electrode and the front substrate, a rear substrate on which an address electrode is positioned to intersect the scan electrode and the sustain electrode, and a barrier rib that is positioned between the front substrate and the rear substrate to partition a discharge cell. The first black layer includes cobalt (Co) material and ruthenium (Ru) material. The barrier rib including lead (Pb) equal to or less than 1,000 ppm (parts per million).

21 Claims, 11 Drawing Sheets

U.S. PATENT DOCUMENTS

| | | | | |
|---|---|---|---|---|
| 7,105,256 | B2 * | 9/2006 | Fukushima | 430/9 |
| 7,125,655 | B2 * | 10/2006 | Mun et al. | 430/319 |
| 7,931,746 | B2 * | 4/2011 | Smith et al. | 106/480 |
| 2004/0214111 | A1 * | 10/2004 | Mun et al. | 430/319 |
| 2006/0019814 | A1 * | 1/2006 | Baik et al. | 501/49 |
| 2006/0119271 | A1 * | 6/2006 | Kim | 313/586 |
| 2007/0298956 | A1 * | 12/2007 | Kwon et al. | 501/49 |
| 2008/0113201 | A1 * | 5/2008 | Matsumoto et al. | 428/426 |

FOREIGN PATENT DOCUMENTS

| | | | |
|---|---|---|---|
| KR | 10-2003-0081586 | | 10/2003 |
| KR | 1020040023957 | A | 3/2004 |
| KR | 10-2004-0092173 | | 11/2004 |
| KR | 1020050023839 | A | 3/2005 |

* cited by examiner

[Fig. 1]
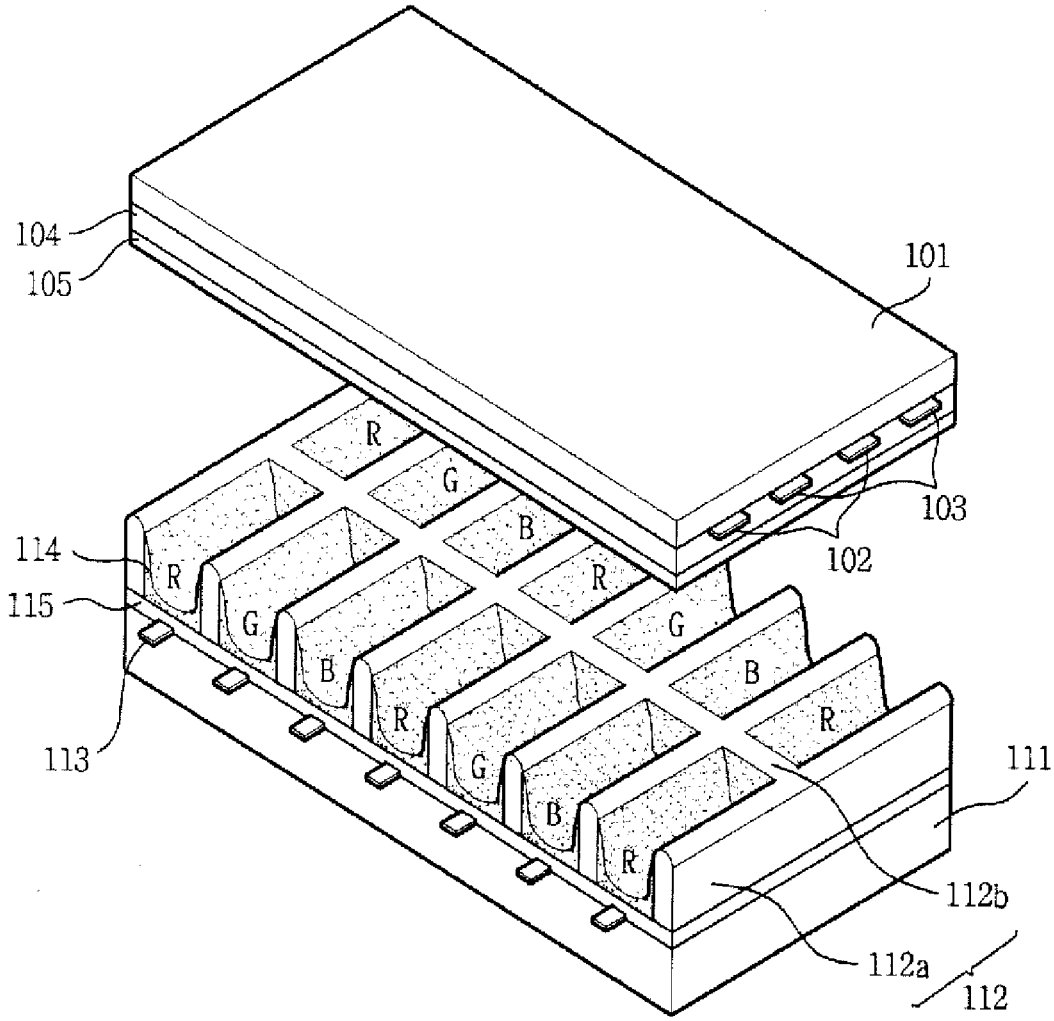

[Fig. 2]
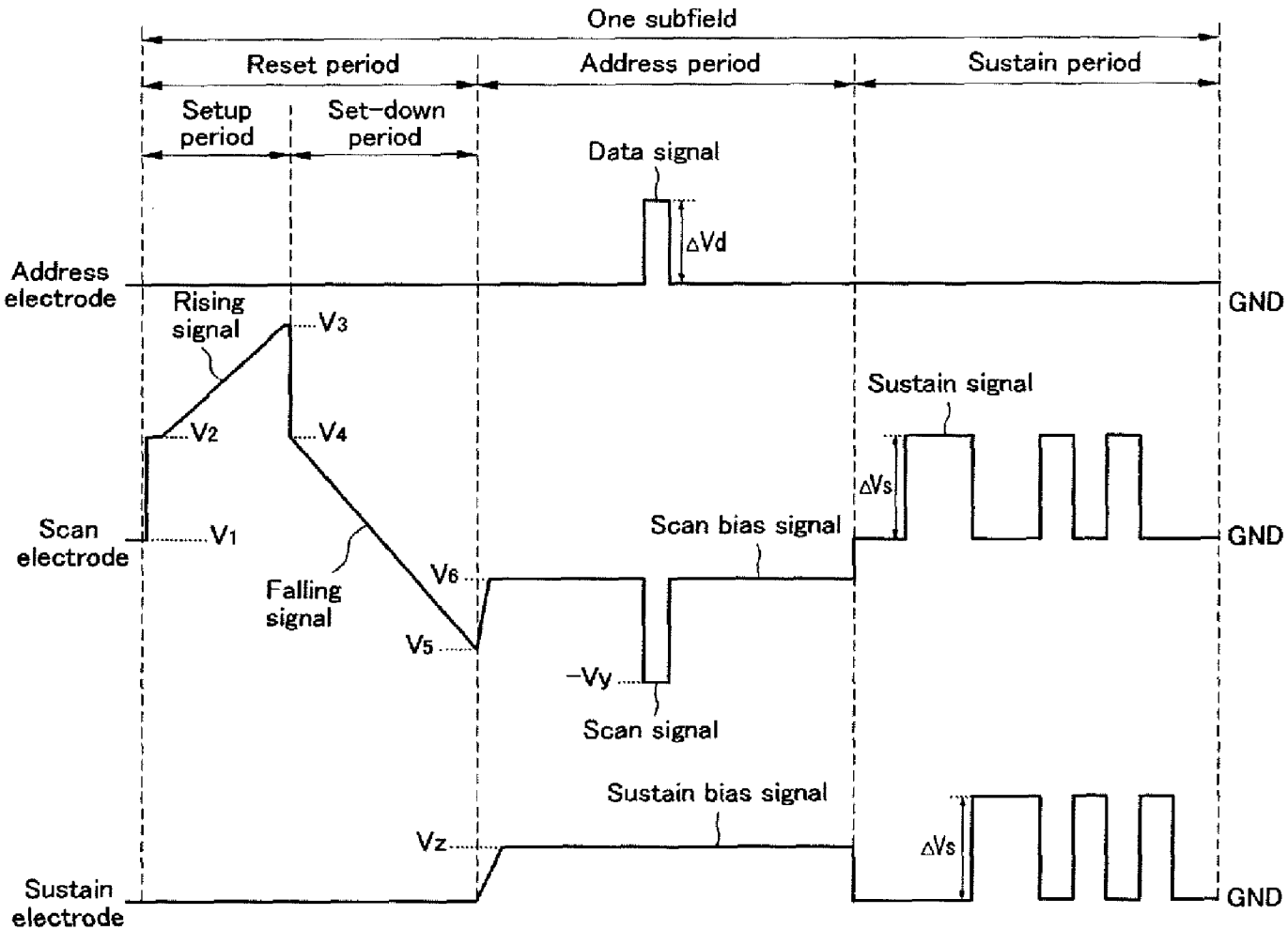

[Fig. 3]
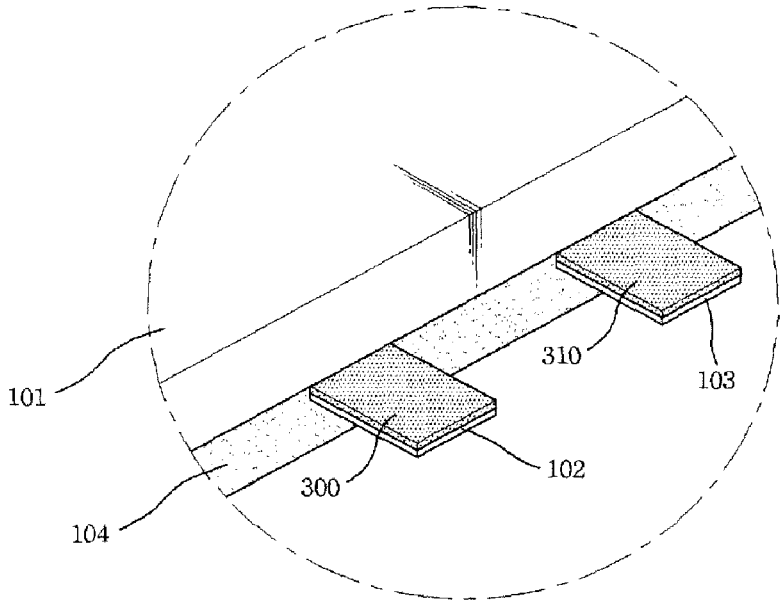
[Fig. 4]
| | Barrier rib | Black material (parts by weight) | | Reflectance (%) | Luminance (cd/m$^2$) |
|---|---|---|---|---|---|
| | | Co | Ru | | |
| Case 1 | Type 1 | 100 | 0 | 72 | 143 |
| Case 2 | Type 1 | 90 | 10 | 29 | 140 |
| Case 3 | Type 1 | 50 | 50 | 26 | 134 |
| Case 4 | Type 2 | 100 | 0 | 33 | 145 |
| Case 5 | Type 2 | 90 | 10 | 29 | 143 |
| Case 6 | Type 2 | 50 | 50 | 27 | 140 |

[Fig. 5]
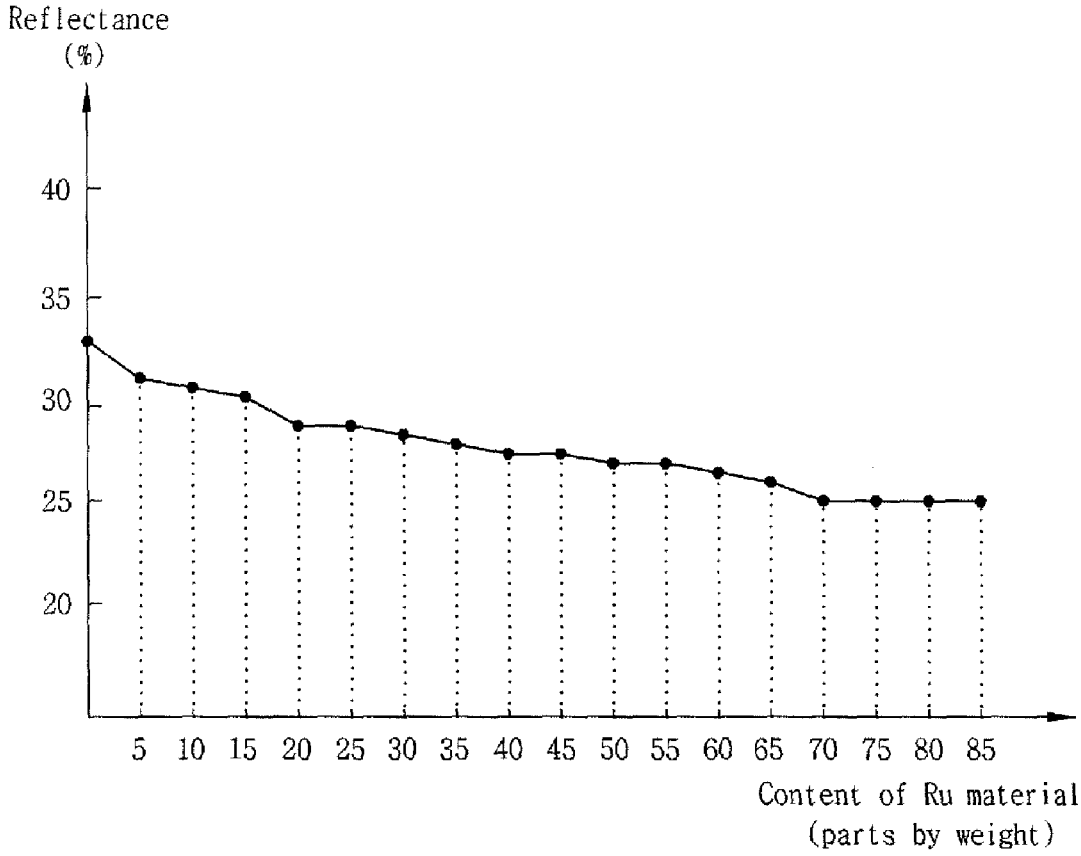

[Fig. 6]
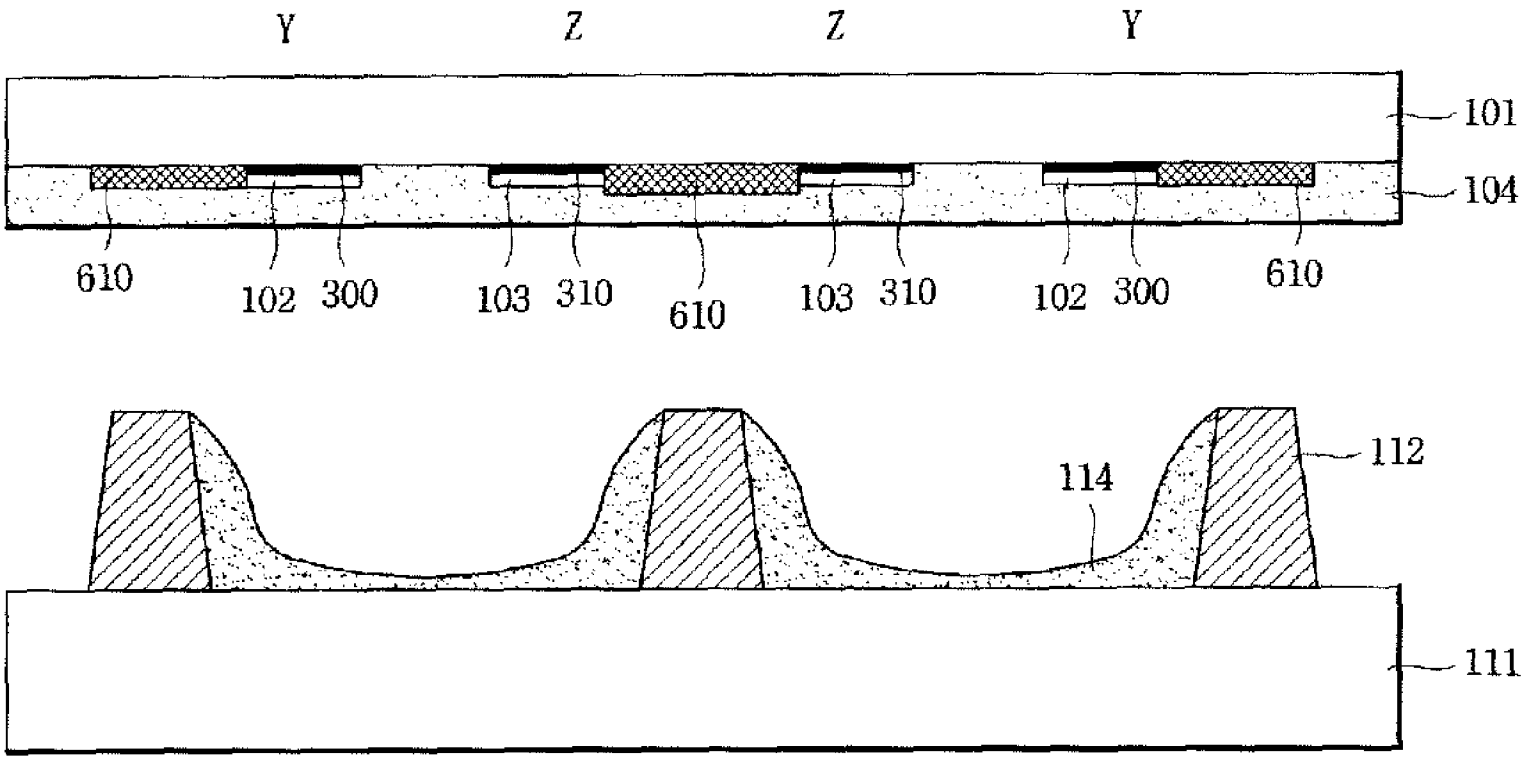

[Fig. 7]
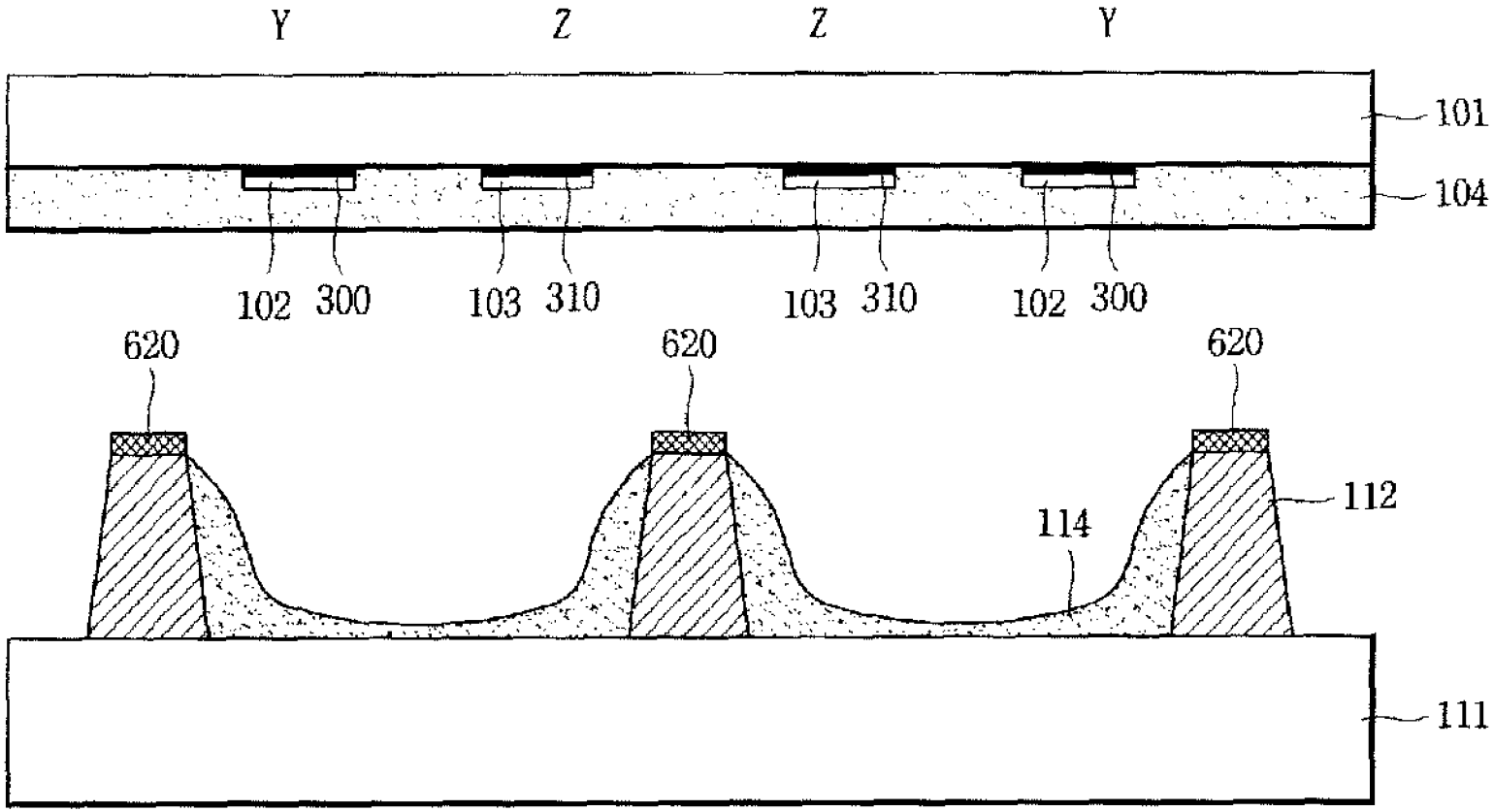

[Fig. 8]
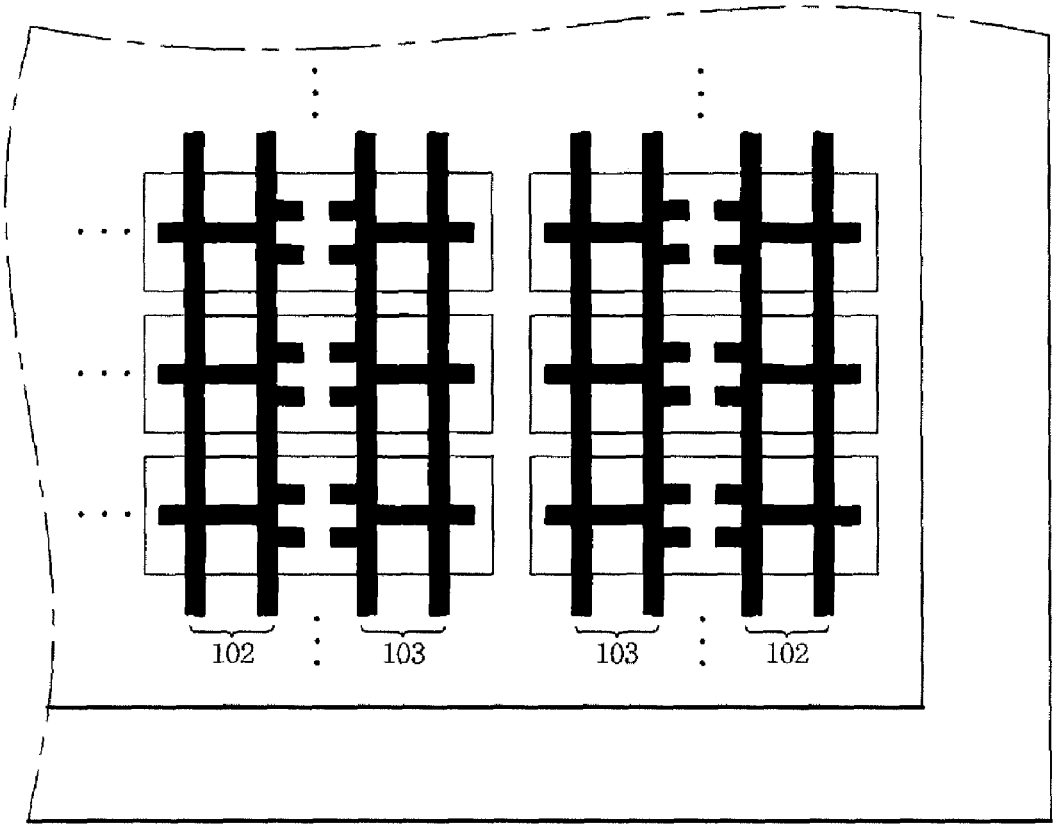

[Fig. 9]
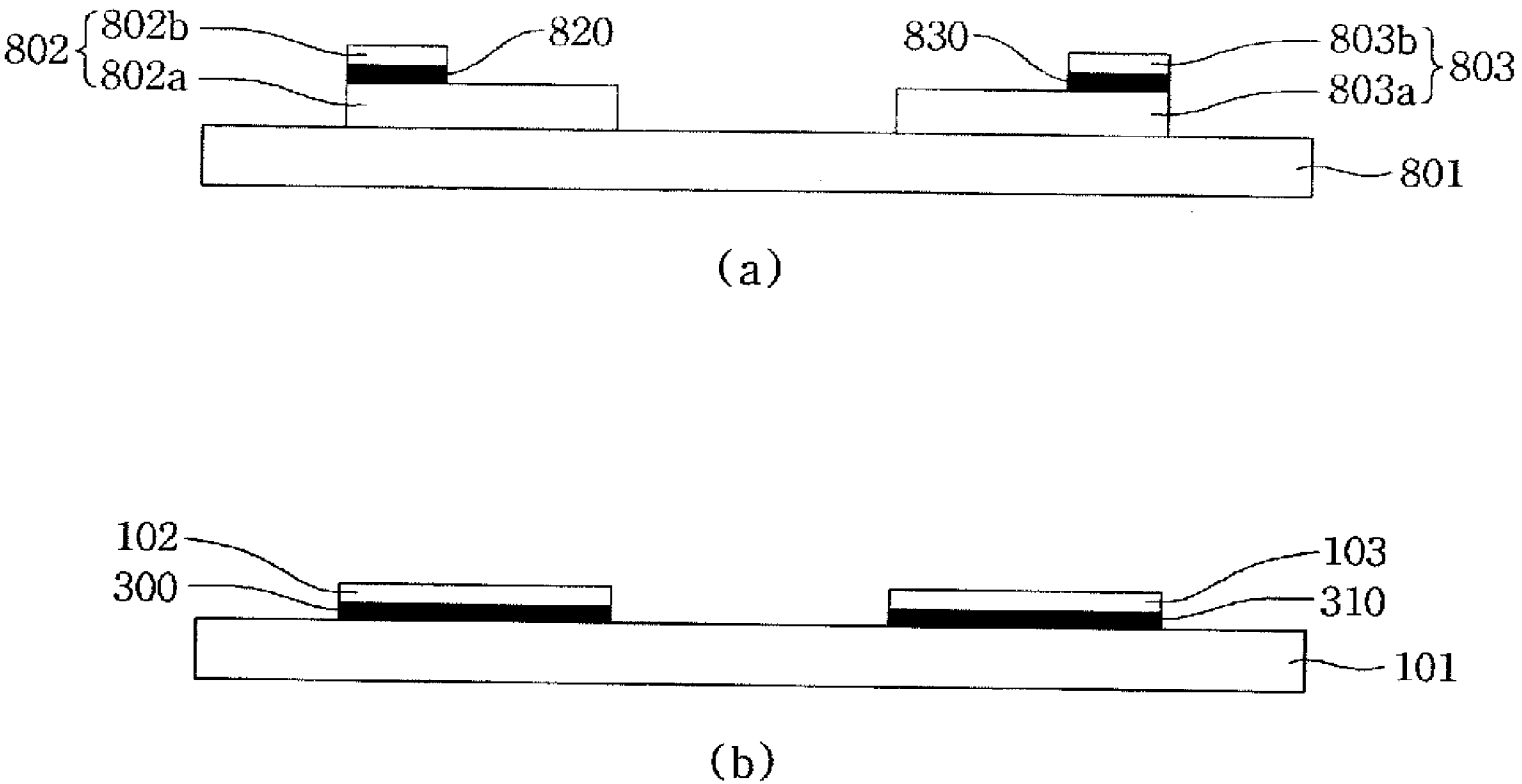

[Fig. 10]
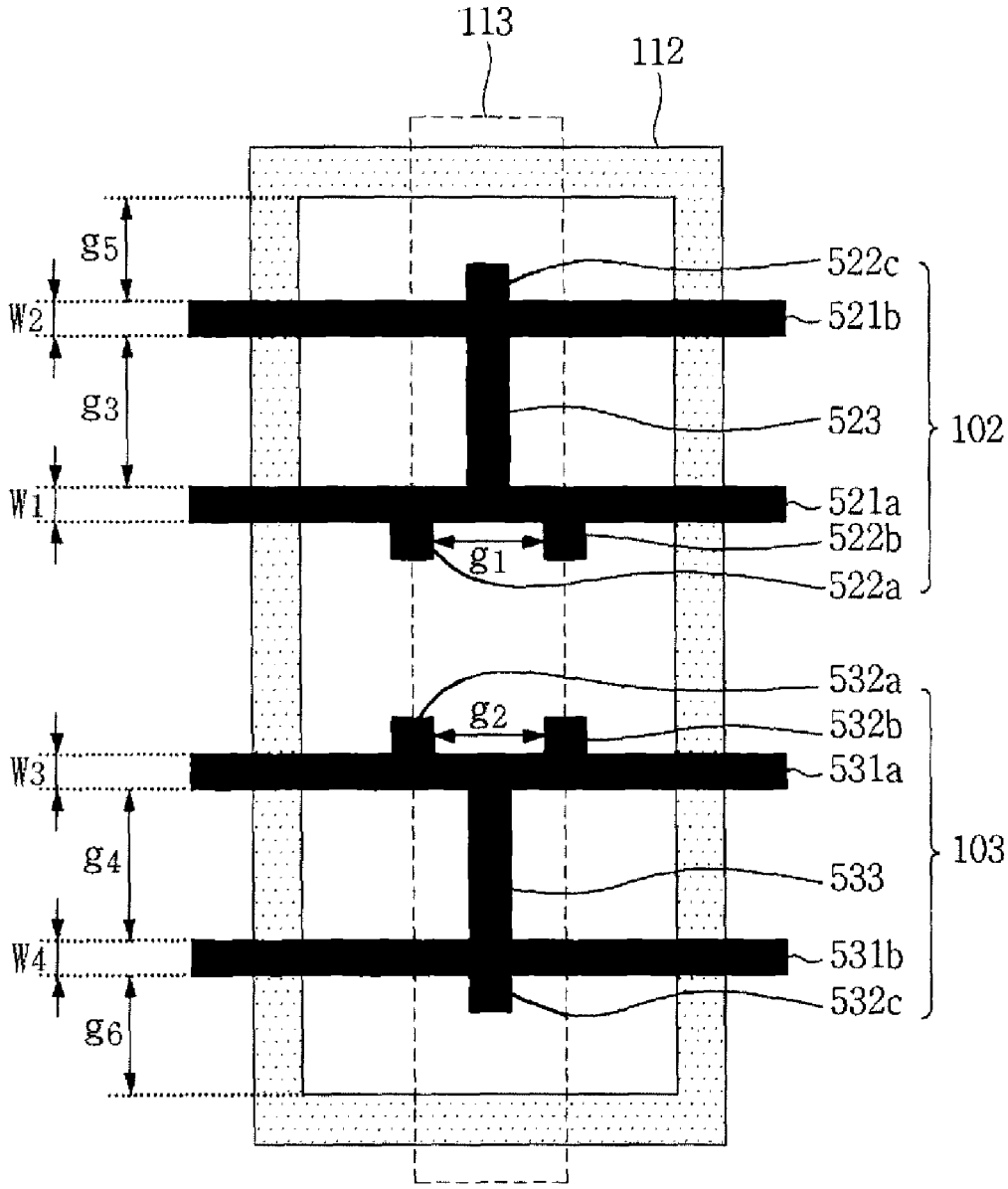

[Fig. 11]
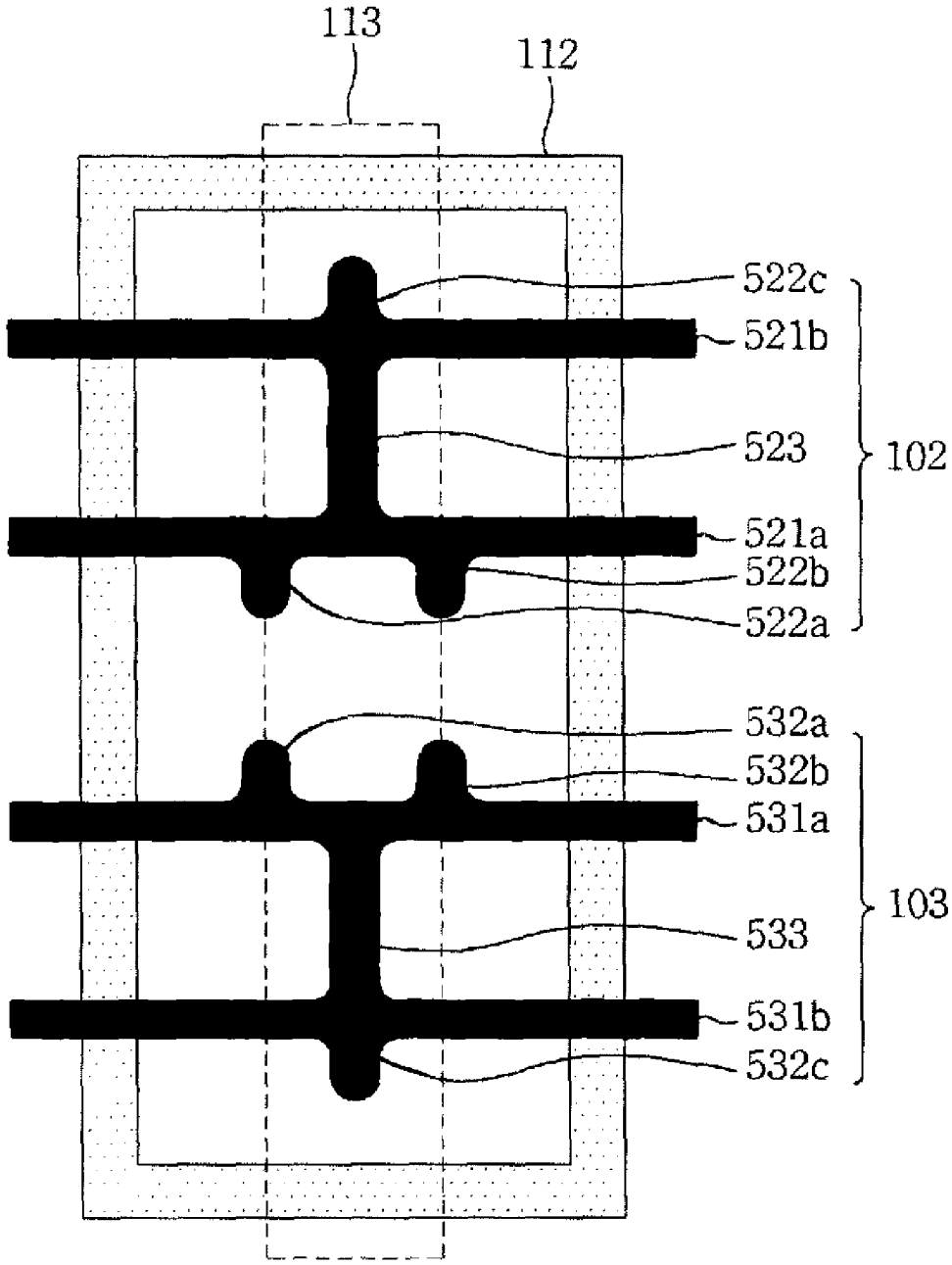

[Fig. 12]
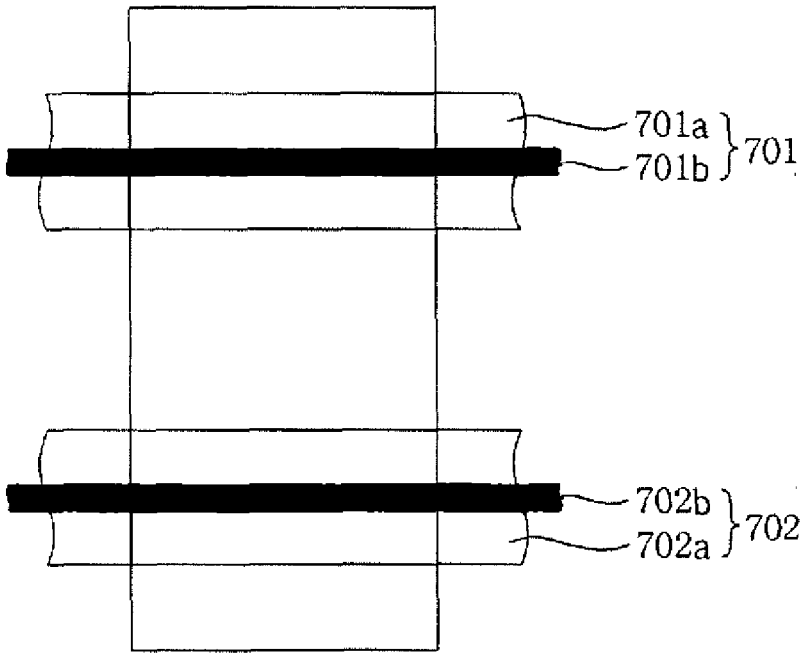
(a)
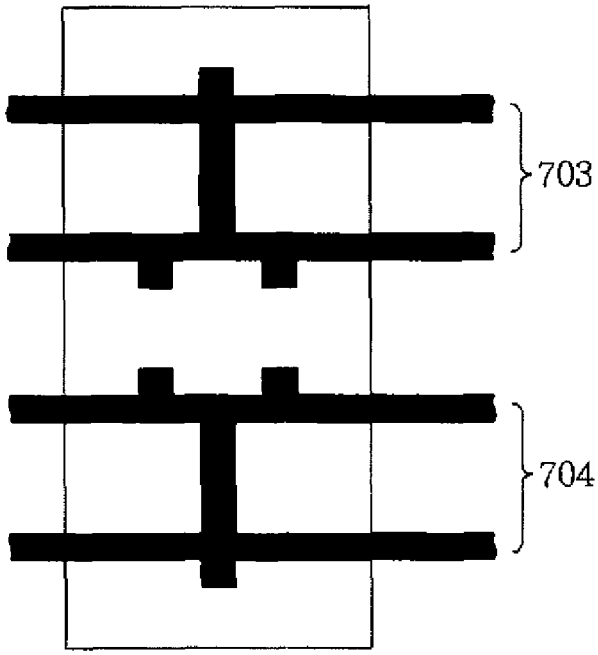
(b)

PLASMA DISPLAY PANEL WITH IMPROVED CONTRAST CHARACTERISTICS

TECHNICAL FIELD

An exemplary embodiment relates to a plasma display panel.

BACKGROUND ART

A plasma display panel includes a phosphor layer inside discharge cells partitioned by barrier ribs and a plurality of electrodes.

When driving signals are applied to the electrodes of the plasma display panel, a discharge occurs inside the discharge cells. In other words, when the plasma display panel is discharged by applying the driving signals to the discharge cells, a discharge gas filled in the discharge cells generates vacuum ultraviolet rays, which thereby cause phosphors positioned between the barrier ribs to emit light, thus producing visible light. An image is displayed on the screen of the plasma display panel due to the visible light.

Disclosure of Invention

BRIEF DESCRIPTION OF THE DRAWINGS

FIG. 1 shows a structure of a plasma display panel according to an exemplary embodiment;

FIG. 2 illustrates an example of an operation of the plasma display panel according to the exemplary embodiment;

FIG. 3 is a diagram for explaining a first black layer;

FIG. 4 is a diagram for explaining a material of a barrier rib and a first black layer;

FIG. 5 is a graph showing a relationship between a reflectance and a content of Ru material;

FIGS. 6 and 7 show another structure of the plasma display panel according to the exemplary embodiment;

FIG. 8 shows a schematic structure of each of a scan electrode and a sustain electrode;

FIG. 9 shows a single-layered structure and a multi-layered structure of each of a scan electrode and a sustain electrode;

FIGS. 10 and 11 show a structure of a scan electrode and a sustain electrode; and FIG. 12 is a diagram for explaining a reason why a first black layer includes both Co and Ru materials in a single-layered electrode structure.

MODE FOR THE INVENTION

FIG. 1 shows a structure of a plasma display panel according to an exemplary embodiment.

As shown in FIG. 1, a plasma display panel according to an exemplary embodiment includes a front substrate 101, on which a scan electrode 102 and a sustain electrode 103 are positioned parallel to each other, and a rear substrate 111 on which an address electrode 113 is positioned to intersect the scan electrode 102 and the sustain electrode 103.

An upper dielectric layer 104 is positioned on the scan electrode 102 and the sustain electrode 103 to provide electrical insulation between the scan electrode 102 and the sustain electrode 103.

A protective layer 105 is positioned on the upper dielectric layer 104 to facilitate discharge conditions. The protective layer 105 may include a material having a high secondary electron emission coefficient, for example, magnesium oxide (MgO).

A lower dielectric layer 115 is positioned on the address electrode 113 to provide electrical insulation of the address electrodes 113.

Barrier ribs 112 of a stripe type, a well type, a delta type, a honeycomb type, and the like, are positioned on the lower dielectric layer 115 to partition discharge spaces (i.e., discharge cells). A red (R) discharge cell, a green (G) discharge cell, and a blue (B) discharge cell, and the like, may be positioned between the front substrate 101 and the rear substrate 111. In addition to the red (R), green (G), and blue (B) discharge cells, a white (W) discharge cell or a yellow (Y) discharge cell may be further positioned.

Widths of the red (R), green (G), and blue (B) discharge cells may be substantially equal to one another. Further, a width of at least one of the red (R), green (G), or blue (B) discharge cells may be different from widths of the other discharge cells. For instance, a width of the red (R) discharge cell may be the smallest, and widths of the green (G) and blue (B) discharge cells may be larger than the width of the red (R) discharge cell. The width of the green (G) discharge cell may be substantially equal or different from the width of the blue (B) discharge cell. Hence, a color temperature of an image displayed on the plasma display panel can be improved.

The plasma display panel may have various forms of barrier rib structures as well as a structure of the barrier rib 112 shown in FIG. 1. For instance, the barrier rib 112 includes a first barrier rib 112*b* and a second barrier rib 112*a*. The barrier rib 112 may have a differential type barrier rib structure in which heights of the first and second barrier ribs 112*b* and 112*a* are different from each other.

In the differential type barrier rib structure, a height of the first barrier rib 112*b* may be smaller than a height of the second barrier rib 112*a*.

While FIG. 1 has been illustrated and described the case where the red (R), green (G) and blue (B) discharge cells are arranged on the same line, the red (R), green (G) and blue (B) discharge cells may be arranged in a different pattern. For instance, a delta type arrangement in which the red (R), green (G), and blue (B) discharge cells are arranged in a triangle shape may be applicable. Further, the discharge cells may have a variety of polygonal shapes such as pentagonal and hexagonal shapes as well as a rectangular shape.

While FIG. 1 has illustrated and described the case where the barrier rib 112 is formed on the rear substrate 111, the barrier rib 112 may be formed on at least one of the front substrate 101 or the rear substrate 111.

Each discharge cell partitioned by the barrier ribs 112 may be filled with a predetermined discharge gas.

A phosphor layer 114 is positioned inside the discharge cells to emit visible light for an image display during an address discharge. For instance, red, green, and blue phosphor layers may be positioned inside the discharge cells. In addition to the red, green, and blue phosphor layers, at least one of white or yellow phosphor layer may be further positioned.

A thickness of at least one of the phosphor layers 114 formed inside the red (R), green (G) and blue (B) discharge cells may be different from thicknesses of the other phosphor layers. For instance, a thickness of the green phosphor layer or the blue phosphor layer may be larger than a thickness of the red phosphor layer. The thickness of the green phosphor layer may be substantially equal or different from the thickness of the blue phosphor layer.

In FIG. 1, the upper dielectric layer 104 and the lower dielectric layer 115 each have a single-layered structure. However, at least one of the upper dielectric layer 104 or the lower dielectric layer 115 may have a multi-layered structure.

While the address electrode 113 may have a substantially constant width or thickness, a width or thickness of the address electrode 113 inside the discharge cell may be different from a width or thickness of the address electrode 113 outside the discharge cell. For instance, a width or thickness of the address electrode 113 inside the discharge cell may be larger than a width or thickness of the address electrode 113 outside the discharge cell.

FIG. 2 illustrates an example of an operation of the plasma display panel according to the exemplary embodiment. The exemplary embodiment is not limited to FIG. 2, and the plasma display can be operated in various manners.

As shown in FIG. 2, during a reset period for initialization, a reset signal is supplied to the scan electrode. The reset signal includes a rising signal and a falling signal. The reset period is further divided into a setup period and a set-down period.

The rising signal is supplied to the scan electrode during the setup period, thereby generating a weak dark discharge (i.e., a setup discharge) inside the discharge cell. Hence, a proper amount of wall charges are accumulated inside the discharge cell.

The falling signal of a polarity opposite a polarity of the rising signal is supplied to the scan electrode during the set-down period, thereby generating a weak erase discharge (i.e., a set-down discharge) inside the discharge cell. Hence, the remaining wall charges are uniform inside the discharge cells to the extent that an address discharge occurs stably.

During an address period following the reset period, a scan bias signal, which is substantially maintained at a sixth voltage V6 higher than a lowest voltage V5 of the falling signal, is supplied to the scan electrode.

A scan signal falling from the scan bias signal is supplied to the scan electrode.

A width of a scan signal supplied during an address period of at least one subfield may be different from widths of scan signals supplied during address periods of the other subfields. A width of a scan signal in a subfield may be larger than a width of a scan signal in a next subfield in time order. For instance, a width of the scan signal may be gradually reduced in the order of 2.6 μs, 2.3 μs, 2.1 μs, 1.9 μs, etc., or may be reduced in the order of 2.6 μs, 2.3 μs, 2.3 μs, 2.1 μs . . . 1.9 μs, 1.9 μs, etc, in the successively arranged subfields.

As above, when the scan signal is supplied to the scan electrode, a data signal corresponding to the scan signal is supplied to the address electrode.

As the voltage difference between the scan signal and the data signal is added to the wall voltage produced during the reset period, the address discharge occurs inside the discharge cell to which the data signal is supplied.

A sustain bias signal is supplied to the sustain electrode during the address period so as to prevent the generation of unstable address discharge by interference of the sustain electrode.

The sustain bias signal is substantially maintained at a sustain bias voltage Vz. The sustain bias voltage Vz is lower than a voltage Vs of a sustain signal and is higher than a ground level voltage GND.

During a sustain period following the address period, the sustain signal may be supplied to at least one of the scan electrode or the sustain electrode. For instance, the sustain signal is alternately supplied to the scan electrode and the sustain electrode.

As the wall voltage inside the discharge cell selected by performing the address discharge is added to the sustain voltage Vs of the sustain signal, every time the sustain signal is supplied, a sustain discharge, i.e., a display discharge occurs between the scan electrode and the sustain electrode.

A plurality of sustain signals are supplied during a sustain period of at least one subfield, and a width of at least one of the plurality of sustain signals may be different from widths of the other sustain signals. For instance, a width of a first supplied sustain signal among the plurality of sustain signals may be larger than widths of the other sustain signals. Hence, a sustain discharge can more stably occur.

FIG. 3 is a diagram for explaining a first black layer.

As shown in FIG. 3, first black layers 300 and 310 may be positioned between the front substrate 101 and the scan electrode 102 and between the front substrate 101 and the sustain electrode 103, respectively.

The first black layers 300 and 310 can prevent a discoloration phenomenon of the front substrate 101 caused by diffusing particles of the scan electrode 102 and particles of the sustain electrode 103 into the front substrate 101. Further, the first black layers 300 and 310 can reduce a panel reflectance and improve a contrast characteristic by preventing the reflection of incident light caused by the scan electrode 102 or the sustain electrode 103.

The scan and sustain electrodes 102 and 103 may have a single-layered structure. The scan and sustain electrodes 102 and 103 may be called an ITO-less electrode in which a transparent electrode is omitted. The scan electrode 102 and the sustain electrode 103 may be a bus electrode.

The scan and sustain electrodes 102 and 103 may be formed of a material that has an excellent electrical conductivity and is easy to treat, for example, silver (Ag), gold (Au), copper (Cu), aluminum (Al).

FIG. 4 is a diagram for explaining a material of a barrier rib and a first black layer.

In FIG. 4, a first black layer includes a black material. The first black layer may be divided into several types depending on the black material for the convenience of explanation. More specifically, a Case 1-typed first black layer includes cobalt (Co) material of 100 parts by weight; a Case 2-typed first black layer includes Co material of 90 parts by weight and ruthenium (Ru) material of 10 parts by weight; and a Case 3-typed first black layer includes Co material of 50 parts by weight and Ru material of 50 parts by weight. FIG. 4 shows a reflectance and a luminance of the plasma display panel including each of the Case 1 to Case 3-typed first black layers.

In FIG. 4, part by weight indicates relative weight percentage considering that the total weight of the black material is 100. For instance, the fact that the black material includes Co material of 90 parts by weight and Ru material of 10 parts by weight is that Co material occupies 90% of the total weight of the black material and Ru material occupies the remaining 10%.

The Case 1 to Case 3-typed first black layers are 1-typed barrier rib. The 1-typed barrier rib is formed using PbO—$B_2O_3$—$SiO_2$ based glass material, and includes lead (Pb) more than 1,000 ppm (parts per million).

Further, FIG. 4 shows a reflectance and a luminance of the plasma display panel including each of Case 4 to Case 6-typed first black layers that include the same black material as the Case 1 to Case 3-typed first black layers, respectively.

The Case 4 to Case 6-typed first black layers are 2-typed barrier rib. The 2-typed barrier rib includes lead (Pb) equal to or less than 1,000 ppm.

As shown in FIG. 4, in the Case 1-typed first black layer, the reflectance is about 72% and the luminance is about 143 cd/$m^2$. In the Case 2-typed first black layer, the reflectance is about 29% and the luminance is about 140 cd/$m^2$. In the Case 3-typed first black layer, the reflectance is about 26% and the luminance is about 134 cd/$m^2$.

As can be seen from FIG. 4, the panel reflectance in the Case 1-typed first black layer not including the Ru material is larger than the panel reflectance in the Case 2 and 3-typed first black layers including the Co and Ru materials.

As above, a reason why the Ru material reduces the panel reflectance is that light absorptance of Ru material is higher than light absorptance of Co material and the first black layer including Ru material better absorbs light coming from the outside.

On the contrary, the Ru material reduces the panel reflectance, but may reduce the luminance due to an increase in the quantity of light absorbed by the first black layer. For instance, the luminance in the Case 1-typed first black layer not including the Ru material is larger than the luminance in the Case 2 and 3-typed first black layers including the Co and Ru materials.

It is advantageous that a Pb content of the barrier rib may be equal to or less than 1,000 ppm so as to prevent a reduction in the luminance in the first black layer including the Ru material.

As shown in FIG. 4, in the Case 4-typed first black layer, the reflectance is about 33% and the luminance is about 145 cd/m$^2$. In the Case 5-typed first black layer, the reflectance is about 29% and the luminance is about 143 cd/m$^2$. In the Case 6-typed first black layer, the reflectance is about 27% and the luminance is about 140 cd/m$^2$.

As can be seen from FIG. 4, the luminance in the 2-typed barrier rib is higher than the luminance in the 1-typed barrier rib. This reason is that the Pb content of the 2-typed barrier rib is smaller than the Pb content of the 1-typed barrier rib. Hence, capacitance of the 2-typed barrier rib is lower than capacitance of the 1-typed barrier rib, and a discharge current in the 2-typed barrier rib is reduced. Therefore, the discharge intensity in the 2-typed barrier rib is larger than the discharge intensity in the 1-typed barrier rib at the same voltage.

When the Pb content of the barrier rib is equal to or less than 1,000 ppm, the reflectance is reduced and the luminance increases even if the first black layer includes the Ru material.

In case that the first black layer includes the Ru material, at least one of the address electrode, the scan electrode, the sustain electrode, the upper dielectric layer or the lower dielectric layer may include Pb equal to or less than 1,000 ppm so as to prevent a reduction in the luminance caused by the Ru material. Hence, the luminance can be further improved. Further, the total Pb content of the panel may be equal to or less than 1,000 ppm.

If Pb is accumulated inside the human body, Pb is a toxic material capable of adversely affecting the human body. Accordingly, when the barrier rib includes Pb equal to or less than 1,000 ppm in the plasma display panel according to the exemplary embodiment, an influence of Pb on the human body can be reduced.

FIG. 5 is a graph showing a reflectance of the plasma display panel while the black material of the first black layer includes the Ru and Co materials and a content of Ru material changes from 0 to 85 parts by weight. The barrier rib includes Pb equal to or less than 1,000 ppm. When a content of Ru material is 0, the first black layer does not include the Ru material.

As shown in FIG. 5, when the content of Ru material is 0, the panel reflectance has a relatively high value of 33%.

When the content of Ru material is 5 parts by weight, the panel reflectance is reduced to 31.5%. When the content of Ru material is 10 parts by weight, the panel reflectance is 31%.

When the content of Ru material increases from 15 to 70 parts by weight, the panel reflectance decreases from 30.5% to 25%. In other words, as the content of Ru material increases in the first black layer, the panel reflectance gradually decreases.

When the content of Ru material is equal to or more than 75 parts by weight, the panel reflectance is not reduced and has a value of about 25%.

Considering the graph of FIG. 5, when the content of Ru material lies in a range between 5 to 70 parts by weight, the panel reflectance gradually decreases as the content of Ru material increases. However, when the content of Ru material is equal to or more than 75 parts by weight, an improvement effect of the panel reflectance is small even if the content of Ru material increases.

Further, when the Ru material that is more expensive than the Co material is excessively used in the first black layer, the manufacturing cost of the panel may increase. Accordingly, the content of Ru material may lie substantially in a range between 5 to 70 parts by weight so as to suppress an increase in the manufacturing cost of the panel and reduce the panel reflectance.

An example of a method of manufacturing the first black layer will be below described.

When total weight of a black composition of the first black layer is 100, a black material of 28 parts by weight, a glass powder of 20 parts by weight, a binder of 20 parts by weight, photopolymerizable monomer of 5 parts by weight, a photopolymerization initiator of 2 parts by weight, and a solvent of 25 parts by weight are mixed to the black composition in a paste state.

The black material may include Ru and Co materials. For instance, the black material may include Ru material of 10 parts by weight and Co material of 18 parts by weight.

The black material may further include at least one of Si, Al, Mn, Ni, Zn, Cu, Mg, Ti, Zr, W, Mo, and P materials in addition to the Ru and Co materials.

The glass powder may be a glass frit containing bismuth oxide, lithium oxide, or zinc oxide as a principal component.

The binder may be an acrylic-based binder.

The photopolymerizable monomer can accelerate the photo-curing of a black paste and improve a development of the black paste.

The black composition may be coated on the front substrate. Afterwards, the black paste coated on the front substrate may be exposed using ultraviolet rays, and then the exposed black paste may be developed to form the first black layer.

FIGS. 6 and 7 show another structure of the plasma display panel according to the exemplary embodiment.

As shown in FIG. 6, a second black layer 610 corresponding to the barrier rib 112 may be positioned on the front substrate 101. The second black layer 610 may be positioned on the front substrate 101 overlapping the barrier rib 112.

The second black layer 610 absorbs incident light, and thus can prevent the barrier rib 112 from reflecting light. Hence, the panel reflectance is reduced, and the contrast characteristic can be improved.

The second black layer 610 may include Co and Ru materials in the same way as the first black layers 300 and 310. The panel reflectance can be reduced due to the second black layer 610.

Although the second black layer 610 is positioned on the front substrate 101 in FIG. 6, the second black layer 610 may be positioned on the upper dielectric layer (not shown).

The second black layer 610 may be positioned between the two sustain electrodes 103 to contact the two sustain electrodes 103.

As shown in FIG. 7, a third black layer 620 may be positioned on the barrier rib 112. When the third black layer 620 is positioned on the barrier rib 112, the panel reflectance can be reduced even if the second black layer is not formed on the front substrate 101.

The third black layer 620 may include Co and Ru materials in the same way as the first black layers 300 and 310.

FIG. 8 shows a schematic structure of each of a scan electrode and a sustain electrode. FIG. 9 shows a single-layered structure and a multi-layered structure of each of a scan electrode and a sustain electrode.

As shown in FIG. 8, the scan electrode 102 and the sustain electrode 103 each having a predetermined pattern may be positioned parallel to each other.

In FIG. 9, (a) shows a scan electrode 802 and a sustain electrode 803 each having a multi-layered structure, (b) shows the scan electrode 102 and the sustain electrode 103 each having a single-layered structure.

In (a) of FIG. 9, the scan electrode 802 and the sustain electrode 803 each include transparent electrodes 802*a* and 803*a* and bus electrodes 802*b* and 803*b*.

The bus electrodes 802*b* and 803*b* may include a substantially opaque material, for instance, at least one of Ag, Au, and Al. The transparent electrodes 802*a* and 803*a* may include a substantially transparent material, for instance, indium-tin-oxide (ITO).

Black layers 820 and 830 may be formed between the transparent electrodes 802*a* and 803*a* and the bus electrodes 802*b* and 803*b* so as to prevent the reflection of external light caused by the bus electrodes 802*b* and 803*b*.

A manufacturing method of the scan electrode 802 and the sustain electrode 803 in (a) of FIG. 9 is as follows. First, a transparent electrode layer is formed on a front substrate 801. Then, the transparent electrode layer is patterned to form the transparent electrodes 802*a* and 803*a*.

A bus electrode layer is formed on the transparent electrodes 802*a* and 803*a*. Then, the bus electrode layer is patterned to form the bus electrodes 802*b* and 803*b*.

On the other hand, the scan electrode 102 and the sustain electrode 103 in (b) of FIG. 9 is formed by forming an electrode layer on the front substrate 101 and patterning the electrode layer. In other words, since the manufacturing method in (b) of FIG. 9 is simpler than the manufacturing method in (a) of FIG. 9, manufacturing time and the manufacturing cost in (b) of FIG. 9 can be reduced.

In (a) of FIG. 9, since the transparent electrodes 802*a* and 803*a* are formed of relatively expensive ITO, the transparent electrodes 802*a* and 803*a* provide a cause of a rise in the manufacturing cost.

In (b) of FIG. 9, since relatively expensive ITO is not used, the manufacturing cost is reduced.

FIGS. 10 and 11 show a structure of a scan electrode and a sustain electrode.

As illustrated in FIG. 10, the scan electrode 102 includes a plurality of line portions 521*a* and 521*b* intersecting the address electrode 113, and projecting portions 522*a*, 522*b* and 522*c* projecting from at least one of the line portions 521*a* and 521*b*. The sustain electrode 103 includes a plurality of line portions 531*a* and 531*b* intersecting the address electrode 113, and projecting portions 532*a*, 532*b* and 532*c* projecting from at the line portions 521*a*, 521*b*, 531*a* and 531*b*.

In FIG. 10, the scan electrode 102 and the sustain electrode 103 each include three projecting portions. However, the number of projecting portions is not limited thereto. For instance, each of the scan electrode 102 and the sustain electrode 103 may include two projecting portions. The scan electrode 102 may include four projecting portions, and the sustain electrode 103 may include three projecting portions.

Further, the projecting portions 522*c* and 532*c* may be omitted from the scan electrode 102 and the sustain electrode 103, respectively.

The line portions 521*a*, 521*b*, 531*a* and 531*b* have a predetermined width, respectively. For instance, the first and second line portions 521*a* and 521*b* of the scan electrode 102 have widths of W1 and W2, respectively. The first and second line portions 531*a* and 531*b* of the sustain electrode 103 have widths of W3 and W4, respectively.

The widths W1, W2, W3 and W4 may have a substantially equal value. At least one of the widths W1, W2, W3 or W4 may have a different value. For instance, the widths W1 and W3 may be about 35 μm, and the widths W2 and W4 may be about 45 μm larger than the widths W1 and W3.

When an interval g3 between the first and second line portions 521*a* and 521*b* of the scan electrode 102 and an interval g4 between the first and second line portions 531*a* and 531*b* of the sustain electrode 103 are excessively large, it is difficult to diffuse a discharge generated between the scan electrode 102 and the sustain electrode 103 into the second line portion 521*b* of the scan electrode 102 and the second line portion 531*b* of the sustain electrode 103. On the other hand, the intervals g3 and g4 are excessively small, it is difficult to diffuse the discharge into the rear of the discharge cell. Accordingly, the intervals g3 and g4 may ranges from about 170 μm to 210 μm, respectively.

To sufficiently diffuse the discharge generated between the scan electrode 102 and the sustain electrode 103 into the rear of the discharge cell, a shortest interval g5 between the second line portion 521*b* of the scan electrode 102 and the barrier rib 112 in a direction parallel to the address electrode 113 and a shortest interval g6 between the second line portion 531*b* of the sustain electrode 103 and the barrier rib 112 in a direction parallel to the address electrode 113 may ranges from about 120 μm to 150 μm, respectively.

At least one of the projecting portions 522*a*, 522*b*, 522*c*, 532*a*, 532*b* and 532*c* projects from the line portions 521*a*, 521*b*, 531*a* and 531*b* toward the center of the discharge cell. For instance, the projecting portions 522*a* and 522*b* of the scan electrode 102 project from the first line portion 521*a* of the scan electrode 102 toward the center of the discharge cell, and the projecting portions 532*a* and 532*b* of the sustain electrode 103 project from the first line portion 531*a* of the sustain electrode 103 toward the center of the discharge cell.

The projecting portions 522*a*, 522*b*, 522*c*, 532*a*, 532*b* and 532*c* are spaced apart from each other at a predetermined interval therebetween. For instance, the projecting portions 522*a* and 522*b* of the scan electrode 102 are spaced apart from each other at an interval of g1. The projecting portions 532*a* and 532*b* of the sustain electrode 103 are spaced apart from each other at an interval of g2. The intervals g1 and g2 may ranges from about 75 μm to 110 μm, respectively, so as to secure the discharge efficiency.

A length of at least one of the projecting portions 522*a*, 522*b*, 522*c*, 532*a*, 532*b* and 532*c* may be different from a length of the other projecting portions. Lengths of the projecting portions each having a different projecting direction may be different from each other. For instance, lengths of the projecting portions 522*a* and 522*b* of the scan electrode 102 may be different from a length of the projecting portion 522*c*, and lengths of the projecting portions 532*a* and 532*b* of the sustain electrode 103 may be different from a length of the projecting portion 532*c*.

The scan electrode 102 and the sustain electrode 103 each include a connection portion for connecting at least two line portions. For instance, the scan electrode 102 includes a connection portion 523 for connecting the first and second line portions 521*a* and 521*b*, and the sustain electrode 103 includes a connection portion 533 for connecting the first and second line portions 531*a* and 531*b*.

A discharge may start to occur the between the projecting portions 522*a* and 522*b* projecting from the first line portion 521*a* of the scan electrode 102 and the projecting portions 532*a* and 532*b* projecting from the first line portion 531*a* of the sustain electrode 103.

The discharge is diffused into the first line portion 521*a* of the scan electrode 102 and the first line portion 531*a* of the sustain electrode 103, and then is diffused into the second line portion 521*b* of the scan electrode 102 and the second line portion 531*b* of the sustain electrode 103 through the connection portions 523 and 533.

The discharge diffused into the second line portions 521*b* and 531*b* is diffused into the rear of the discharge cell through the projecting portion 522*c* of the scan electrode 102 and the projecting portion 532*c* of the sustain electrode 103.

As illustrated in FIG. 11, at least one of the projecting portions 521*a*, 521*b*, 521*c*, 531*a*, 531*b* and 531*c* may have a portion with the curvature. At least one of the projecting portions 521*a*, 521*b*, 521*c*, 531*a*, 531*b* and 531*c* may have an end portion with the curvature.

Further, a portion connecting the projecting portions 521*a*, 521*b*, 521*c*, 531*a*, 531*b* and 531*c* to the line portions 521*a*, 521*b*, 531*a* and 531*b* may have a curvature.

Further, a portion connecting the line portions 521*a*, 521*b*, 531*a* and 531*b* to the connection portions 523 and 533 may have a curvature.

As above, when the scan electrode 102 and the sustain electrode 103 each have the portion with the curvature, the scan electrode 102 and the sustain electrode 103 can be manufactured more easily. Further, the excessive accumulation of wall charges on a predetermined portion of the scan electrode 102 and the sustain electrode 103 can be prevented during a driving of the panel, and thus the panel can be stably driven.

FIG. 12 is a diagram for explaining a reason why a first black layer includes both Co and Ru materials in a single-layered electrode structure.

In FIG. 12, (a) shows a scan electrode 701 and a sustain electrode 702 each having a multi-layered structure as in (a) of FIG. 9, and (b) shows a scan electrode 703 and a sustain electrode 704 each having a single-layered structure as in (b) of FIG. 9.

In (a) of FIG. 12, the scan electrode 701 and the sustain electrode 702 each include transparent electrodes 701*a* and 702*a* and bus electrodes 701*b* and 702*b*. Hence, a firing voltage between the scan electrode 701 and the sustain electrode 702 cab be sufficiently reduced and a discharge between the scan electrode 701 and the sustain electrode 702 can be diffused more widely.

On the contrary, in (b) of FIG. 12, because a transparent electrode is omitted, the entire area of each of the scan electrode 703 and the sustain electrode 704 has to be wide so as to prevent an excessive rise in a firing voltage between the scan electrode 703 and the sustain electrode 704 and to efficiently diffuse a discharge between the scan electrode 703 and the sustain electrode 704. Accordingly, the scan electrode 703 and the sustain electrode 704 each occupy a relatively large area inside the discharge cell.

Although it is not shown, in case that a reflectance of a first black layer positioned between the scan electrode 703 and the sustain electrode 704 is relatively high, a panel reflectance is high and a contrast characteristic may worse.

On the contrary, as in the exemplary embodiment, in case that a first black layer positioned between the scan electrode 703 and the sustain electrode 704 includes Co and Ru materials, a panel reflectance is low and a contrast characteristic can be improved.

As described above, since the plasma display panel according to the exemplary embodiment includes the first black layer including the Co and Ru materials and the barrier rib including Pb equal to or less than 1,000 ppm, a panel reflectance can be reduced and a contrast characteristic can be improved. Further, the image quality of a displayed image can be improved due to the improvement of the contrast characteristic.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

The invention claimed is:

1. A plasma display panel comprising:

a front substrate on which a scan electrode and a sustain electrode are positioned;

a first black layer positioned between the scan electrode and the front substrate and between the sustain electrode and the front substrate, the first black layer including cobalt (Co) material and ruthenium (Ru) material;

a rear substrate on which an address electrode is positioned and oriented to overlap the scan electrode and the sustain electrode; and a barrier rib that is positioned between the front substrate and the rear substrate to partition a discharge cell, the barrier rib including lead (Pb) equal to or less than 1,000 ppm (parts per million) and greater than 0 ppm.

2. The plasma display panel of claim 1, wherein a lower dielectric layer is positioned on the address electrode, and the lower dielectric layer includes lead equal to or less than 1,000 ppm.

3. The plasma display panel of claim 1, wherein an upper dielectric layer is positioned on the scan electrode and the sustain electrode, and the upper dielectric layer includes lead equal to or less than 1,000 ppm.

4. The plasma display panel of claim 1, wherein a second black layer corresponding to the barrier rib is positioned on the front substrate, and the second black layer includes the cobalt material and the ruthenium material.

5. The plasma display panel of claim 1, wherein a third black layer is positioned on the barrier rib, and the third black layer includes the cobalt material and the ruthenium material.

6. The plasma display panel of claim 1, wherein a content of ruthenium material is substantially between 5 and 70 parts by weight.

7. A plasma display panel comprising:

a front substrate on which a scan electrode and a sustain electrode are positioned, the scan electrode and the sustain electrode each having a single-layered structure;

a first black layer positioned between the scan electrode and the front substrate and between the sustain electrode and the front substrate, the first black layer including cobalt (Co) material and ruthenium (Ru) material;

a rear substrate on which an address electrode is positioned and oriented to overlap the scan electrode and the sustain electrode; and a barrier rib that is positioned between the front substrate and the rear substrate to partition a discharge cell, the barrier rib including lead (Pb) equal to or less than 1,000 ppm (parts per million) and greater than 0 ppm.

8. The plasma display panel of claim 7, wherein a lower dielectric layer is positioned on the address electrode, and the lower dielectric layer includes lead equal to or less than 1,000 ppm.

9. The plasma display panel of claim 7, wherein an upper dielectric layer is positioned on the scan electrode and the sustain electrode, and the upper dielectric layer includes lead equal to or less than 1,000 ppm.

10. The plasma display panel of claim 7, wherein a second black layer corresponding to the barrier rib is positioned on the front substrate, and the second black layer includes the cobalt material and the ruthenium material.

11. The plasma display panel of claim 7, wherein a third black layer is positioned on the barrier rib, and the third black layer includes the cobalt material and the ruthenium material.

12. The plasma display panel of claim 7, wherein a content of ruthenium material is substantially between 5 and 70 parts by weight.

13. The plasma display panel of claim 7, wherein the scan electrode and the sustain electrode are a bus electrode.

14. The plasma display panel of claim 13, wherein the scan electrode and the sustain electrode each include:

a plurality of line portions that overlap the address electrode;

at least one connection portion that connects at least two line portions of the plurality of line portions to each other; and at least one projecting portion that projects from the plurality of line portions.

15. The plasma display panel of claim 6, wherein the content of ruthenium material is substantially between 15 and 70 parts by weight and a luminance of the plasma display panel is substantially between 25% and 35%.

16. The plasma display panel of claim 12, wherein the content of ruthenium material is substantially between 15 and 70 parts by weight and a luminance of the plasma display panel is substantially between 25% and 35%.

17. The plasma display panel of claim 1:

wherein the first black layer includes a pair of segments, and further comprising a second black layer electrically connected to the pair of segments of the first black layer, the second black layer being positioned between the front substrate and the barrier rib.

18. The plasma display panel of claim 17, wherein a thickness of the second black layer is greater than a thickness of the first black layer.

19. The plasma display panel of claim 7:

wherein the first black layer includes a pair of segments, and further comprising a second black layer electrically connected the pair of segments of the first black layer, the second black layer being positioned between the front substrate and the barrier rib.

20. The plasma display panel of claim 19, wherein a thickness of the second black layer is greater than a thickness of the first black layer.

21. A plasma display panel comprising:

a front substrate;

a rear substrate separated from and oriented substantially parallel to the front substrate;

one or more address electrodes, each positioned between the front and rear substrate;

one or more scan electrodes positioned between the address electrodes and the rear substrate;

one or more sustain electrodes positioned between the address electrodes and the rear substrate;

one or more first black layers positioned between the one or more scan electrodes and the front substrate and between the one or more sustain electrodes and the front substrate, the one or more first black layers each including cobalt (Co) material and ruthenium (Ru) material; and at least one barrier rib positioned between the front substrate and the rear substrate to partition a discharge cell, the at least one barrier rib including lead (Pb) equal to or less than 1,000 ppm (parts per million) and greater than 0 ppm.

* * * * *